US005577724A

United States Patent [19]

Gandolfo

[11] Patent Number: 5,577,724

[45] Date of Patent: Nov. 26, 1996

[54] FOOTBALL

[76] Inventor: Paul J. Gandolfo, 1405 E. 98th St., Brooklyn, N.Y. 11236

[21] Appl. No.: 385,467

[22] Filed: Feb. 8, 1995

[51] Int. Cl.[6] ..... A63B 41/08

[52] U.S. Cl. ..... 273/65 A; 273/65 EG; D21/205

[58] Field of Search ..... D21/203, 204, D21/205; 273/65 EG, 65 EC, 65 ED, 65 R, 65 A, 65 F

[56] References Cited

U.S. PATENT DOCUMENTS

| | | | |
|---|---|---|---|
| 2,011,760 | 8/1935 | Gallinant | 273/65 EG |
| 2,270,553 | 1/1942 | Potito | 273/65 EG |
| 2,448,731 | 9/1948 | Park | 273/65 EG |
| 2,866,644 | 12/1958 | Gow et al. | 273/65 EG |
| 3,708,170 | 1/1973 | Presnell | 273/65 EG X |
| 4,531,737 | 7/1985 | Jacobson et al. | 273/65 EG X |
| 4,991,840 | 2/1991 | Patton | 273/65 EE X |
| 5,342,043 | 8/1994 | Baltronis et al. | 273/65 EC |

*Primary Examiner*—George J. Marlo
*Attorney, Agent, or Firm*—Michael I. Kroll

[57] ABSTRACT

A football comprising:

a. an elongated football having four equally spaced seams extending the length of said football;

b. lacings mounted on two of said seams located on opposite sides of said football to provide additional gripping surfaces on said football while maintaining perfect balance in said football, said lacings extending only along the central portion of said football.

1 Claim, 1 Drawing Sheet

FOOTBALL

BACKGROUND OF THE INVENTION

1. Technical Field of the Invention

The present invention relates, generally, to an improved ball useful for playing football.

More particularly, the present invention relates to an improved ball for playing the American version of the game of football, in which a conventional football is provided with a second lacing for gripping the football. The two laces of the football of the present invention are preferably, located on two of the seams of the football and diametrically opposed to one another.

2. Description of the Prior Art

The prior art includes variations of a conventional football used to play the American version of the game on both the professional and collegiate, such as those disclosed in U.S. Pat. No. 2,011,760, issued to M. Gallinant on Aug. 20, 1935; U.S. Pat. No. 2,270,553, issued to R. J. Potito on Jan. 20, 1942; U.S. Pat. No. 2,448,731, issued to A. Park on Sep. 7, 1948; U.S. Pat. No. 3,708,170, issued to W. Presnell on Jan. 2, 1973; and, U.S. Pat. No. 4,991,840, issued to J. Patton on Feb. 12, 1991.

U.S. Pat. No. 2,011,760

M. Gallinant

U.S. Pat. No. 2,011,760, to M. Gallinant, discloses a football having an anti-skid boot or sheath for the football. The anti-skid sheath envelopes the football and provides a means for firmly gripping the football, but falls to disclose or suggest the provision of multiple lacings for the football or the inherent benefit of having a plurality of lacings, i.e., that a player may readily grip the ball more easily without having to search for the single lacing.

U.S. Pat. No. 2,270,553

R. J. Potito

U.S. Pat. No. 2,270,553, to R. J. Potito, discloses a variation of the anti-skid covering disclosed in U.S. Pat. No. 2,011,760. The lacing in U.S. Pat. No. 2,270,553 is nothing more than a strand material and, again, there is no disclosure of providing multiple lacings to the football.

U.S. Pat. No. 2,448,731

A. Park

U.S. Pat. No. 2,448,731, to A. Park, discloses a gripping means for various types of game balls including, but not limited to, footballs. This reference involves gripping means which are applied to the conventional shaped leather casing of a game ball for enabling players to obtain a firm grip thereon, thereby facilitating handling, spinning or curving of the ball, as occasion may require. The game ball, itself, is conventional in all other respects.

U.S. Pat. No. 3,708,170

W. Presnell

U.S. Pat. No. 3,708,170, to W. Presnell, discloses a football having an extended lacing length and corresponding cross loops, which are provided for accommodating football players with small hands and to improve the ball handling and passing manipulation. This prior art reference discloses nothing more than a single, extended lacing length for an otherwise conventional football.

U.S. Pat. No. 4,991,840

J. Patton

U.S. Pat. No. 4,991,840, to J. Patton, discloses an uninflated tethered football practice kicking aid. The football disclosed therein is fabricated from a specific injection molded thermoplastic polyester elastomer. The football is disclosed as having conventional lacing and structure similar to that of an ordinary football, but for the material out of which it is constructed. The purpose of the apparatus disclosed in this reference is not to provide an improved football, which is clearly not the case, but, rather, to assist persons in practicing the art of kicking a conventional football.

None of the foregoing prior art references disclose or suggest a football having a plurality of lacings, which provides players with an improved means for gripping the football and adds balance to the weight and structure of the football, thereby improving the passing performance of players.

Further disadvantages inherent in prior art articles will become apparent as the present invention is further described in this Specification.

SUMMARY OF THE INVENTION

It is, therefore, an object of the present invention to provide a football having a plurality of lacings, preferably two lacings, which will provide greater balance to the football and will allow players to improve their passing performance.

It is a further object of the present invention to provide a twin-laced football wherein a player running with the football may "tuck" the ball between his arm and upper body and, thereby, allow the plurality of lacings to provide an anti-skid means for allowing the runner to grasp the ball more efficiently and securely.

It is, yet, an additional object of the present invention to provide a twin-laced football which would allow players attempting to catch the football an improved means for gripping the ball.

It is, still, a further object of the present invention to provide a football wherein a quarterback receiving the twin-laced football of the present invention is able to find a lacing for throwing the ball in half the time, as a result of having at least two lacings on the football.

It is an additional object of the present invention to provide an improved football which is economical to provide and easy to manufacture.

Other objects and features of the present invention will become apparent when considered in light of the accompanying drawing figures. It should, however, be recognized that the accompanying drawing figures are intended solely for the purpose of illustrating certain preferred embodiments of the present invention and are not intended as a means for defining the limits and scope of the instant invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
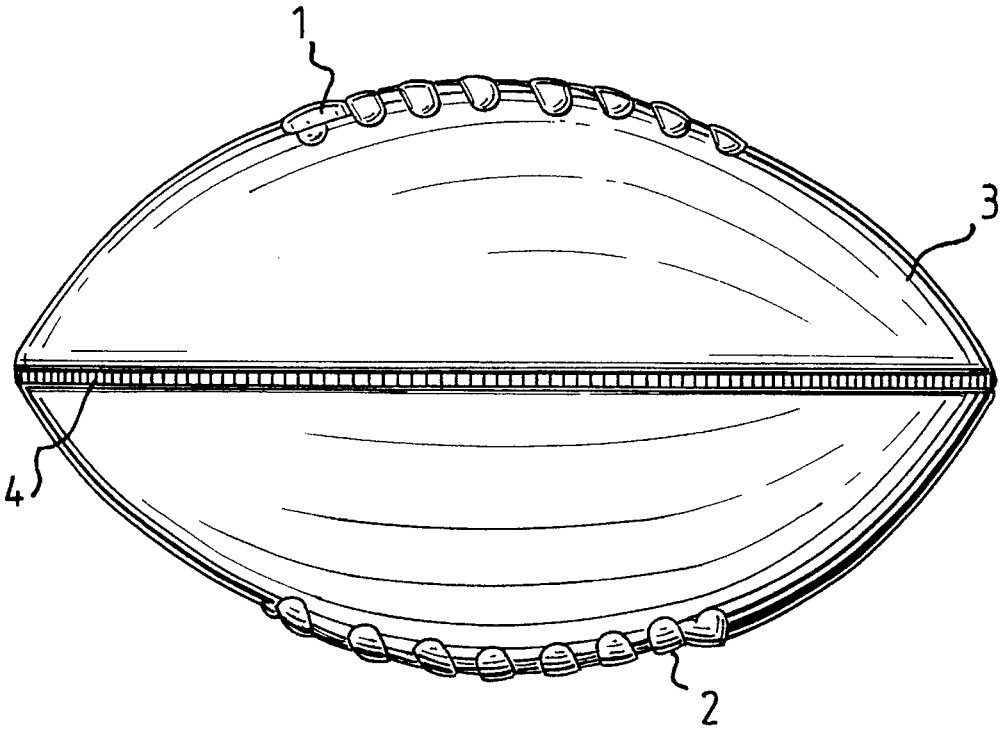
FIG. 1 is a side view of the football of the present invention showing two lacings and illustrating the positions of the lacings.

Turning now, in detail, to an analysis of the accompanying drawing figures, FIG. 1 is a side, elevational view of a twin-laced elongated football 3 of the present invention. Twin-laced football 3, as with a conventional football, has four seams extending the length of said football as illustrated. Lacings 1, 2, are provided along two of the four seams of the football 3. In the embodiment illustrated in FIG. 1, no lacing is provided along seam 4. An additional seam, without lacing is, preferably, provided on the backside of football 3, which is not visible in FIG. 1.

Lacings 1, 2 extend only along the central portion of said football and are diametrically opposed to one another, as are the two seams not having lacings.

More particularly, the first lace is one a first seam, while the second lacing is one a third seam, thereby making them equally divided on a conventional football and adding balance and stability to the football. As is well known to persons having ordinary skill in the art, conventional footballs generally are made with four seams spaced equally around the length of the football.

The additional lacing would be expected to double the chances of one finding the lacings of the football within a given time period.

It should be appreciated that the football of the present invention, while preferably to be made having two lacings along two of the four seams diametrically opposed to one another, may also be constructed with four lacings with one lacing along each of the four seams.

While it is possible to provide a football with only three lacings, clearly, such a construction would not be particularly preferred since it would detract from the balance of the football and, therefore, would not be expected to provide superior performance over the preferred twin-laced football or a four-lacings football.

In this regard, it should be noted that a conventional football having no lacings would, theoretically, be perfectly balanced, i.e., 100% balanced. A football with one lacing would be, approximately 97 balanced, and one with three lacings would be 99% balanced. A football with two lacings diametrically opposed to one another, i.e., on opposite sides of the football, would be 100% balanced, otherwise, a football with two lacings would be expected to be only about 98% balanced.

Figure 2:
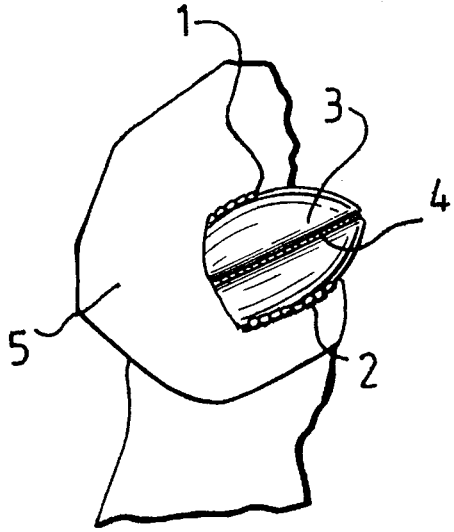
FIG. 2 is a front view of the football illustrated in FIG. 1, showing it tucked within a player's arm; and, FIG. 3 is a front view of the football of the present invention showing it as being caught by a player.

FIG. 2 of the drawing presents a front, or elevational, view of the twin-laced football 3 of the present invention as being tucked underneath a player's arm 5. The twin lacings 1, 2, act to provide a double anti-slip, or, anti-skid, means for the arm of the player to secure the player. This is twice the skid, or slip, protection which is available from a conventional football.

Figure 3:
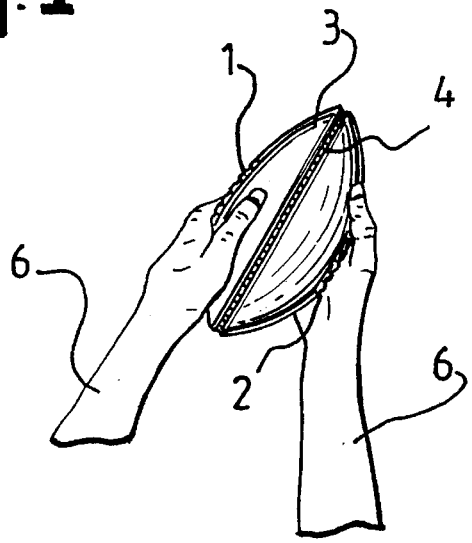

Finally, FIG. 3 is an elevational view of a player catching the twin-laced football 3 of the present invention. Since it is well known that the lacing of the football improves the ability of players to obtain control of the ball once it comes within their possession, the player receiving the football has twice the likelihood of grasping the football by the lacing than is the case with a conventional football.

When reference to the lacing of the football, it should be understood that the inventor is referring to those features which are conventionally thought of as comprising the single lacing of a conventional football. The term "lacing," as used in this disclosure is not intended to a molded covering, as some footballs are known to have, but is intended to include a molded simulation of laces.

LIST OF REFERENCE NUMERALS

1—first lacing of football

2—second lacing of football

3—twin-laced football

4—one of two seams of football, not provided with lacing

5—arm of player running with the twin-laced football

6—hands and arms of the player catching the twin-laced football

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A football comprising:

a. an elongated football having four equally spaced seams extending the length of said football;

b. lacings mounted on two of said seams located on opposite sides of said football to provide additional gripping surfaces on said football while maintaining perfect balance in said football, said lacings extending only along the central portion of said football.

* * * * *